US009908333B2

(12) United States Patent
Gonzalez Perello et al.

(10) Patent No.: US 9,908,333 B2
(45) Date of Patent: Mar. 6, 2018

(54) LATCHING SYSTEMS

(71) Applicants: HEWLETT-PACKARD DEVELOPMENT COMPANY, L.P., Houston, TX (US); Daniel Gonzalez Perello, Sant Cugat del Valles (ES); Kurt Vandenbergh, Sant Cugat del Valles (ES); Santiago Forcada, Sant Cugat del Valles (ES); Francesc Roure Pastor, Sant Cugat del Valles (ES); Joan Sanjuan, Sant Cugat del Valles (ES)

(72) Inventors: Daniel Gonzalez Perello, Terrassa (ES); Kurt Vandenbergh, Sant Cugat del Valles (ES); Santiago Forcada, Sant Cugat del Valles (ES); Francesc Roure Pastor, Sant Cugat del Valles (ES); Joan Sanjuan, Sant Cugat del Valles (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 15/316,723

(22) PCT Filed: Jun. 6, 2014

(86) PCT No.: PCT/EP2014/061871
§ 371 (c)(1),
(2) Date: Dec. 6, 2016

(87) PCT Pub. No.: WO2015/185160
PCT Pub. Date: Dec. 10, 2015

(65) Prior Publication Data
US 2017/0144437 A1 May 25, 2017

(51) Int. Cl.
*B41J 2/14* (2006.01)
*B41J 25/34* (2006.01)

(52) U.S. Cl.
CPC ..... *B41J 2/1433* (2013.01); *B41J 25/34* (2013.01); *B41J 2002/14491* (2013.01)

(58) Field of Classification Search
CPC . B41J 2/1433; B41J 25/34; B41J 2002/14491
See application file for complete search history.

(56) References Cited

U.S. PATENT DOCUMENTS 4,907,018 A * 3/1990 Pinkerpell ..... B41J 2/1752 346/139 R
5,984,465 A * 11/1999 Yun ..... B41J 2/17553 347/87

(Continued)

FOREIGN PATENT DOCUMENTS

EP 0729844 A1 9/1996
EP 0890442 A1 1/1999

(Continued)

*Primary Examiner* — Henok Legesse
(74) *Attorney, Agent, or Firm* — HP Inc. Patent Department

(57) ABSTRACT

An inkjet printer has a print bar system comprising a print bar and a plurality of selectively replaceable print heads attached to the print bar. The system comprises a receptor on the bar, for installation of a print head, each print head having a rear face for insertion in said receptor in a first direction. A latch is provided, pivoted on the bar. The latch has a user-actuatable handle adapted, during a first movement thereof, to engage a latch member of the latch with a catch on the bar to lock the latch in a lockable position on the bar. A platform is mounted on the latch with freedom to move with respect to the latch in said first direction when the latch is in said lockable position. The platform has a latch electrical connector, adapted to engage a head electrical convector on the print head, by mutual movement of the (Continued)

connectors in said first direction. A bias means urges the platform in said first direction. A second movement of the handle releases the platform for movement relative to the latch under the action of the bias means. When the latch is in the lockable position, and the print head is installed in the receptor, the first movement of the handle locks the latch in the lockable position and the second movement of the handle releases the platform so that the bias means presses the platform in said first direction to engage said electrical connectors and urge the print head into secure engagement with the receptor.

20 Claims, 13 Drawing Sheets

(56) References Cited

U.S. PATENT DOCUMENTS

| | | | | |
|---|---|---|---|---|
| 6,443,555 | B1 | 9/2002 | Silverbrook et al. | |
| 6,494,630 | B2 | 12/2002 | Williams et al. | |
| 6,513,904 | B1 | 2/2003 | Taylor et al. | |
| 7,219,980 | B2 | 5/2007 | Silverbrook | |
| 7,712,986 | B2 | 5/2010 | DeVore et al. | |
| 8,011,754 | B2 | 9/2011 | Silverbrook | |
| 8,057,024 | B2 | 11/2011 | Silverbrook | |
| 2006/0227164 | A1* | 10/2006 | Schneider | B41J 25/34 347/37 |

FOREIGN PATENT DOCUMENTS

| | | | |
|---|---|---|---|
| EP | 1464496 | A1 | 10/2004 |
| EP | 1706273 | | 10/2006 |

* cited by examiner

LATCHING SYSTEMS

BACKGROUND

On a print bar of a page-wide array ink-jet printer, a plurality of print heads are usually disposed in side-by-side relation, each of which is generally arranged to be consumer-replaceable. An electronics connection is required between the printer (the print bar) and the print head. At the same time, the print head requires a fluid connection to transport air and/or printing fluid such as ink to the print head. The print head fires the ink at a print media according to a pattern electronically communicated to it through the electronics connection.

BRIEF DESCRIPTION OF THE DRAWINGS

An example within the scope of the present disclosure is described hereinafter with reference to the drawings, in which.

DETAILED DESCRIPTION

Figure 1:
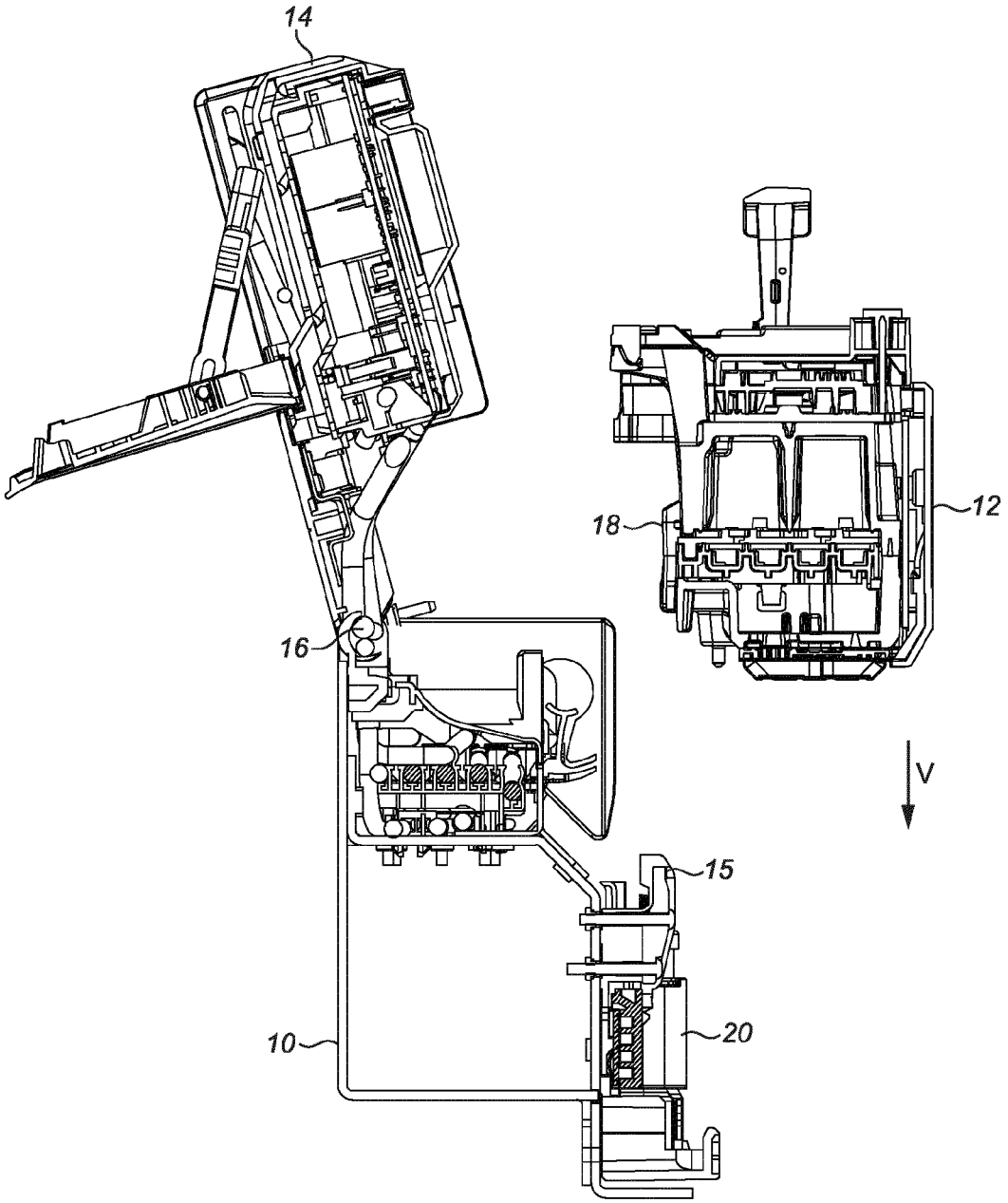
FIG. 1 is a side section through a page-wide array printer bar, and detached print head, according to an example.

In a page-wide array ink-jet printer, the position of the print head relative to the print bar must be known so that the ink is directed accurately by the print head. The print bar and print head generally have datum surfaces that, once engaged, accurately determine the position of the print head, both positionally in three-dimensions, as well as angularly in three axes.

If the print heads are each considered to be essentially cubic in form, they have almost all sides already in use for different functions: their bottom surface has the print jets and is employed for firing ink at the paper or material to be printed; the sides of the print heads are closely adjacent other print heads; their back is employed for attachment to the print bar; their front for auxiliary systems (or to accommodate the next print bar); and their top for user replacement. There is no side that is obviously free for electronics connection.

A latching mechanism may be used to retain the print head in place. The invention is as defined in the claims.

With reference to the drawings, a page wide array printer may have a printer bar 10 across its width and on which are mounted a plurality of printer head modules 12, also referred to herein as print heads. The modules effect the printing onto paper moving underneath the modules. They have ink jets and electronic components to control the ejection of ink from the jets, as is well known in the ink jet printing art. To reduce customer maintenance costs, the print head module is intended to be a user replaceable consumable, which means it has to offer a satisfying customer experience when replacing it. However, there are three requirements of the print head modules and their relation with the printer bar. A first is that the print heads are accurately positioned on the bar, both in terms of position in three-dimensional space, and also angularly about the three orthogonal axes. Otherwise the printer may not print accurately. The second is that there are fluid connections between the printer and the modules, for the transport of ink and air to the print heads. And thirdly there must be electrical connections so that the print instructions can be communicated from the printer to the modules.

For the first purpose, the printer bar 10 and the modules 12 have mutually engaging datum faces (not shown in the drawings but schematically illustrated in FIG. 9), so that, when a print head module is correctly fitted, the datum faces in the three orthogonal planes and axes ensure that the print head is properly positioned with respect to the printer bar. It is possible to arrange that a constant unidirectional force is all that is needed to press the faces together in three orthogonal directions. This can be arranged by mutually engaging ramped tracks on the bar and print-head, down which tracks the print head is pressed during installation. Gravity may be employed during fitting, but ultimately a mechanical latch, optionally with a spring bias that locks the print head in place, is necessary to secure the print head against deflection from its required position, for example by vibration in the printer during use, or paper jams or during transportation, and to return the print head after any deflection that might occur.

For the second purpose, the printer bar and print head module are each provided with mutually engaging fluid connectors. These may be arranged to connect and seal by relative movement between the printer bar and print head in a linear direction. Furthermore, the fluid connector on the printer bar may include a valve, so that fluid in the conduit leading to the connector does not leak out when a module is being changed. The valve may be a check valve, which is automatically disengaged from a seat when the connection between the respective connectors is made. However, other means of connecting fluid conduits to the print head may be feasible.

For the third purpose, the printer bar and print head module are each provided with mutually engaging electrical connectors. These may comprise a Peripheral Component Interconnect Express (PCIe) edge connector, which can be made and broken by relative movement between the printer bar and print head in a linear direction.

Thus, turning to FIG. 1, the print head module 12 is shown separated from the print bar 10, which print bar has a plurality of latches 14 hinged to the print bar about axis 16. The print module is lowered (in the normal operating position of the printer as shown in the drawings) so that locator lugs (shown schematically at 19 in FIG. 9) on a rear face 18 of the print head 12 engage in a receptor 20 on the print bar, which receptor is arranged to direct the print head into its datum position with respect to the print bar. Datum faces (shown schematically at 22 in FIG. 9) position the print head, provided that a vertical force (in the direction of Arrow V in the drawings) is applied to the print head 12 with respect to the print bar 10.

The latching system 14 is the mechanism responsible for ensuring a correct connection between the print head module and the printer. This function includes the electrical (signal and power), fluidic (ink and air) and mechanical (forces) interaction.

In a single bar page wide array printer with a row of several print head modules this function becomes even more critical, as the failure of any of these connections may cause a highly visible defect on the one-pass printing mode. The arrangement illustrated and described herein allows an optimal use of the real estate available on a page wide array print bar in order to ensure a reliable and easy-to-use latching system.

Figure 3A:
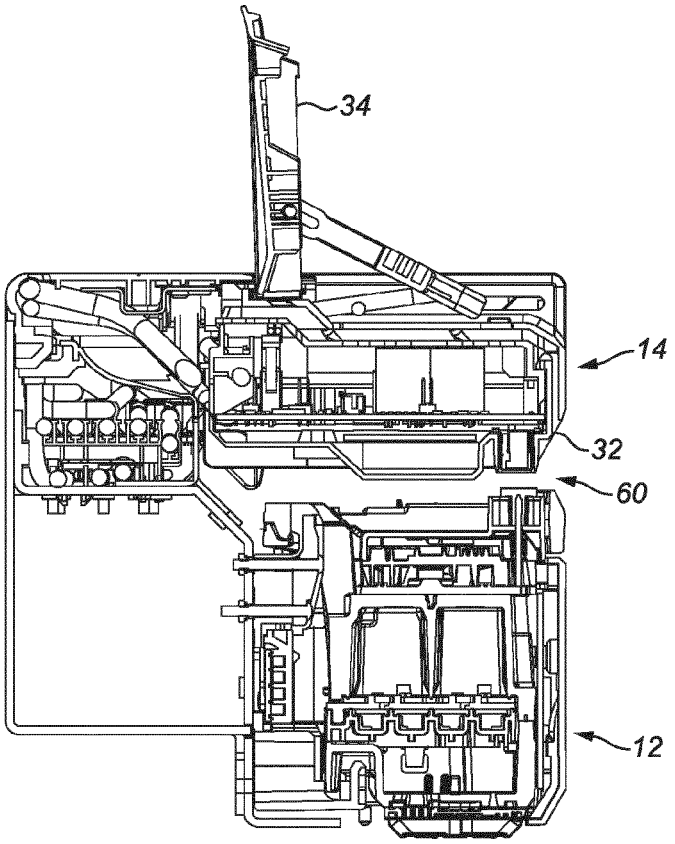
FIGS. 3*a* and *b* are a side section of the view arrangement in FIG. 2, but with a latch of the bar in a locked position, respectively unlocked (with a handle in an open position) and locked (with the handle in a closed position), according to an example.
Figure 4:
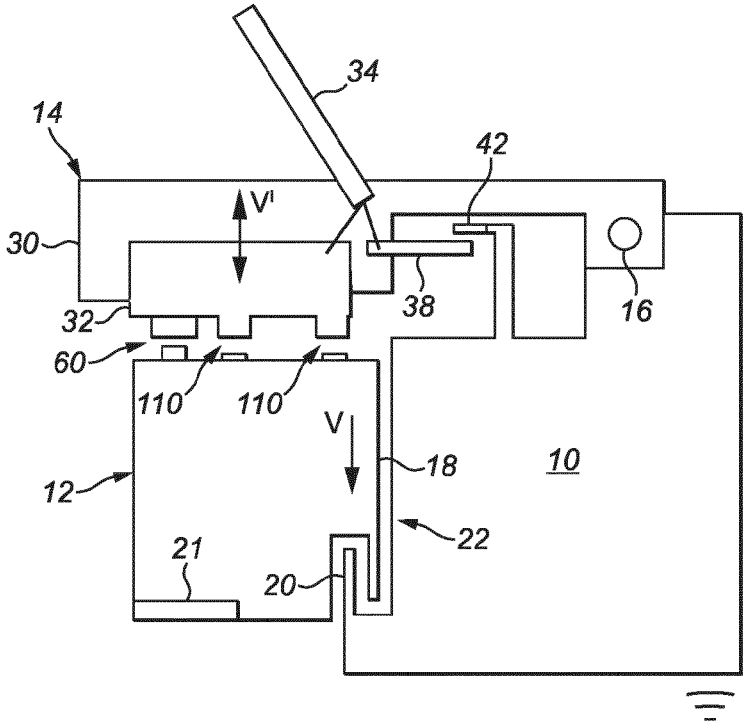
FIG. 4 is a generalised schematic representation of one example of the present disclosure, according to an example.
Figure 9:
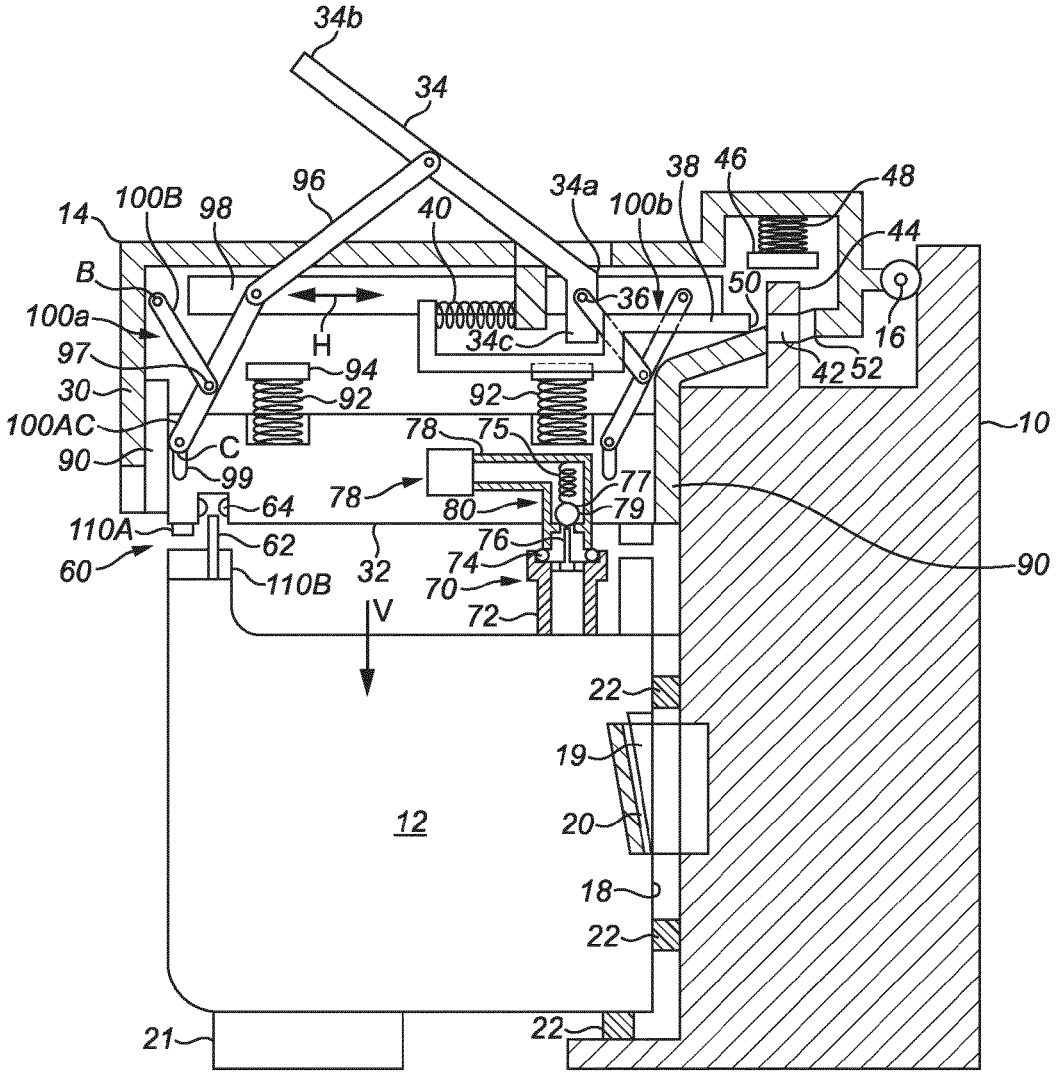
FIG. 9 is a schematic view in side section showing the workings of a printer bar, its latch, the handle of the latch, and a print head, of the arrangements illustrated above, according to an example.
Figure 10:
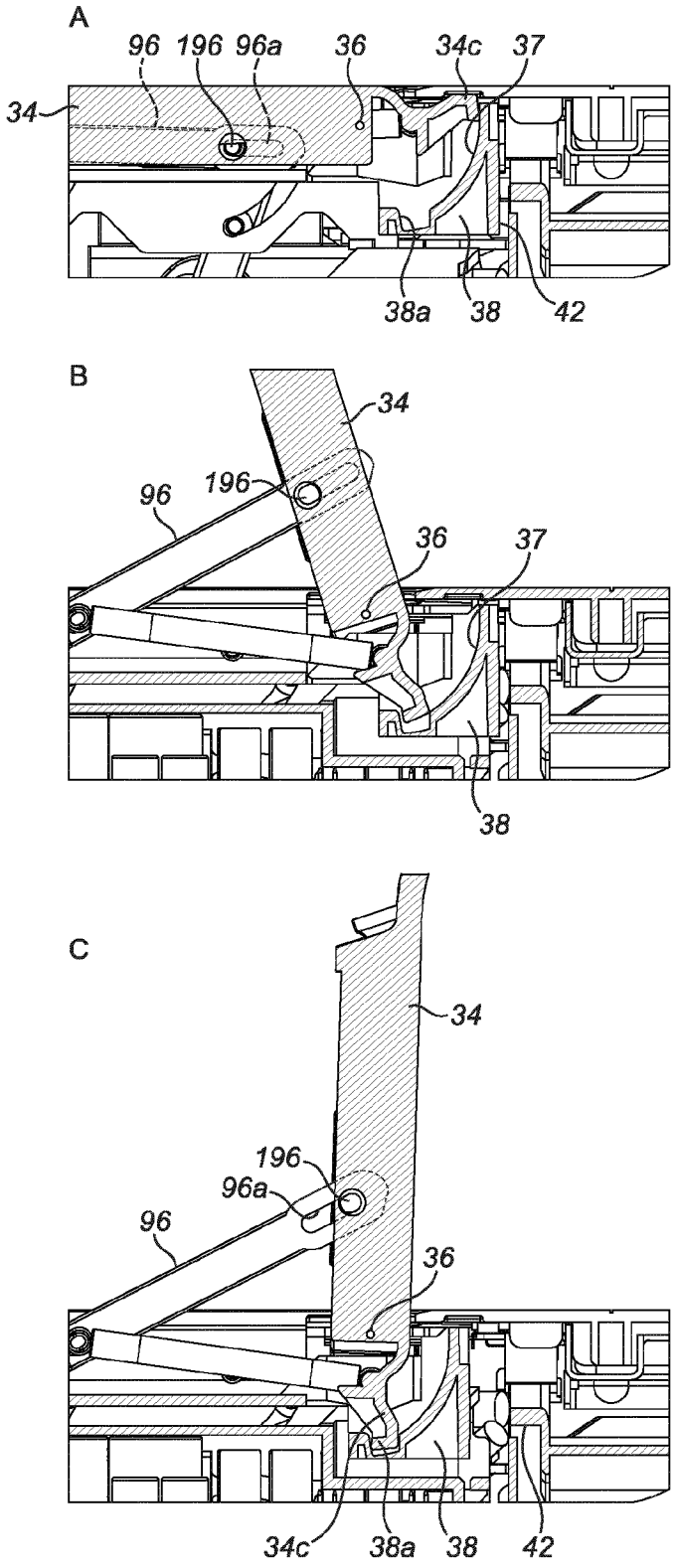
FIGS. 10A,B and C are side sections through a latch in its lockable position, with its handle in a closed position, an intermediate position and a fully open position, according to an example.

Turning to FIGS. 4 and 9, latch 14 comprises a body 30 pivoted at hinge 16 to the bar 10. The body includes a floating platform or board enclosure 32, which is capable of movement in a direction V', which is the vertical direction V when the latch 14 is in a lockable position of the latch as shown in FIGS. 4 and 9, and in FIGS. 3*a* and *b* also.

Referring specifically to FIG. 4, the latch 14 has a handle 34, operatively connected to a latch member 38 and to platform 32. The latch member 38, when operated by a first movement of the handle, engages eye 42 on the printer bar 10 and locks the latch 14 to the printer bar. On a second movement of the handle 34, which may be simultaneous with the first movement or subsequent thereto, platform 32 is urged with respect to the body 30 in the direction of the arrow V'. During this movement, electrical connection 60 is made between the platform and print head 12. Fluid connections may also be made at the same time by the same movement. Once made, stud faces 110 of the platform and print head engage and press the print head 12 in the direction of the arrows V,V' so that the datum faces 22 of the print head and print bar 10 engage and precisely locate and secure the print head with respect to the print bar, whereby the position and orientation of inkjets 21 of the print head 12 are assured.

Turning to FIG. 9, the handle 34 here is pivoted at one end 34*a* in the body 30 about a hinge axis 36. The other end 34*b* is user actuatable. The handle 34 has an extension 34*c* beyond its end 34*a* and hinge 36. This is arranged to engage the latch member 38, which is slidable against spring bias 40 in a horizontal direction substantially orthogonal to direction V. In a first movement of the handle 34 (anti-clockwise in FIG. 9 from a fully open position of the handle) latch member 38 engages eye 42 provided on the bar 10, so that, with the hinge 16, the latch member 38 locks the latch 34 with respect to the bar 10.

Figure 2:
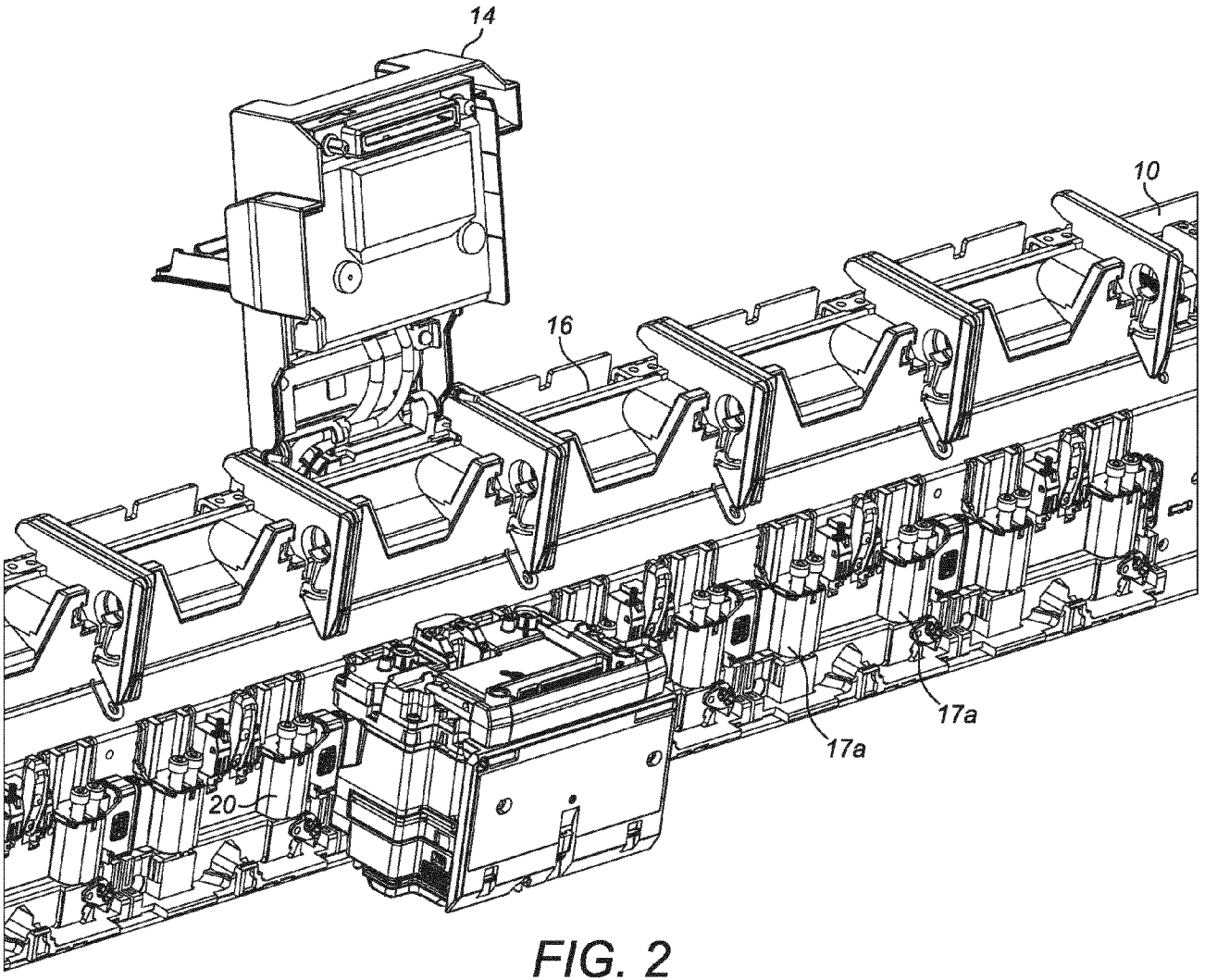
FIG. 2 is a perspective view of the printer bar of FIG. 1, but with the print head installed on the bar, according to an example.

The eye 42 is formed on a block-unlock element 44. The block-unlock 44 is arranged to displace a block 46, against spring bias 48, so that latch member 38 can move rightwardly (in the direction of the arrows H in FIG. 9). However, when the latch 14 is in its open position (shown in FIGS. 1 and 2, for instance) block 46 is able to occupy a position between shoulder 50 of latch member 38 and a stop 52 in the body 30 of the latch 14. With the block in this position, the latch cannot move horizontally, which then prevents the handle 34 from being pivoted anticlockwise about its hinge 36. That is, the handle 34 cannot be closed unless the block 46 is displaced (as shown in FIG. 9) which only occurs in normal use when the latch 14 is pivoted to the lockable position shown in FIG. 9 and the block-unlock element 44 engages the block 46. The purpose of this arrangement is explained further below.

Electrical interface between the latch 14 and the print head 12 takes place through a vertical PCIe connection 60. Fluidic interface is built through vertical fluid interconnects 70, including a primer valve 80 in the platform 32.

Platform 32 may be approximately guided for vertical movement by guides 90 in the body 30 of the latch 14. The platform is urged by springs 92 in the direction of the arrow V (when the latch 14 is in the lockable position shown in FIG. 9). The springs act against stops 94 in the body 30. The springs 92 are illustrated as coil springs, but of course any kind of bias may be employed that performs the requisite biasing function.

The platform is held with the springs compressed by the handle 34 when it is in its open position. A lever 96 is pivoted in the handle 34 intermediate its ends 34*a,b*. The other end of the lever 96 is pivoted in a push bar 98 that slides in the body 30 in a horizontal direction (arrows H). At each end of the push bar is a Scott-Russel link 100*a,b* having three ends, one end (A) pivoted in the push bar, one end (B) pivoted in the body 30 and the third end C pivoted on the platform 32. Link 100AC is solid, whereas arm 100B is pivoted at 97 to link 100AC intermediate its ends. The effect of the links 100*a,b* is that horizontal movement of the push bar 98 is translated into vertical movement of the platform 32 with high gearing or leverage, so that a large movement of the handle 34 results in a small movement of the platform. This means that the springs 92 can be relatively strong without significant effort being expended in turning the handle 34.

When the latch is in the lockable position (as shown in FIG. 9), and the handle is in a fully open position, the arrangement is that, as the handle is moved towards a closed position (rotated anticlockwise in FIG. 9), the latch member 38 engages the eye 42 and locks the latch 14 in position. On further movement of the handle 34, push bar 98 moves horizontally leftwardly, actuating links 100*a,b* to descend platform 32 vertically. Firstly, electrical connector 60 is made, where edge 62 of a printed circuit board in the print head 12 engages connection pins 64 of the PCIe connector pair 60. At the same time, fluid couplings 70 (indeed, possibly several of them, if ink of different colours is connected through the latch) are made. These comprise a head fluid conduit 72, having an O-ring 74 and a probe 76, on the print head 12, and a latch fluid conduit 78, incorporating a check valve 79, on the platform 32. When the probe 76 enters the latch fluid conduit 78 ball 77 of the check valve 79 is displaced against the pressure of return spring 75 to open the valve and permit fluid communication between the conduits 72,78. At the same time, conduits 72,78 are sealed by O-ring 74 between them.

The fluid connection 70 between the latch 14 and the print head may comprise only an air connection, including an electrically operated pump 80 in the platform 32. In that event, check valve 79 may be omitted. Air may be supplied on occasion to the print head to assist cleaning of the print jets. Ink connections may instead be provided directly between the print bar 10 and print head 12. For example, print head 12 may have two pairs of downwardly directed ink ports that are adapted to engage with corresponding upstanding ports 17*a* (see FIG. 2) directly on the print bar 10. It is to be observed that a small amount of tolerance is needed in all three axes so that connections between the print head and print bar do not overcome the positioning determined by the datum system 22.

Once both electrical and fluid connections have been made, stud faces 110A,B (optionally four pairs of them) on the platform 32 and print head 12 abut one another and when the handle 34 is fully closed, the full force of the springs 92 are applied against the print head 12 securely maintaining it in full engagement with its datum system 22. For this purpose, an element 99 of lost motion may be provided between the end C of the links 100*a,b* and the platform 32. Indeed, an element of lost motion may be provided at any point in the connection between the handle 34 and the platform 32 to accommodate tolerance in the engagement between the platform and print head, which may be caused by variations in the fit of the print head in the receptor 20 or any of its dimensions. The handle 34 may be provided with a clip to hold it snugly in a closed position in the latch.

Thus, the mechanism translates the rotation done by the user through the handle 34 into a vertical movement of the floating platform, allowing the three connections mentioned above to be made substantially simultaneously.

Figure 3B:
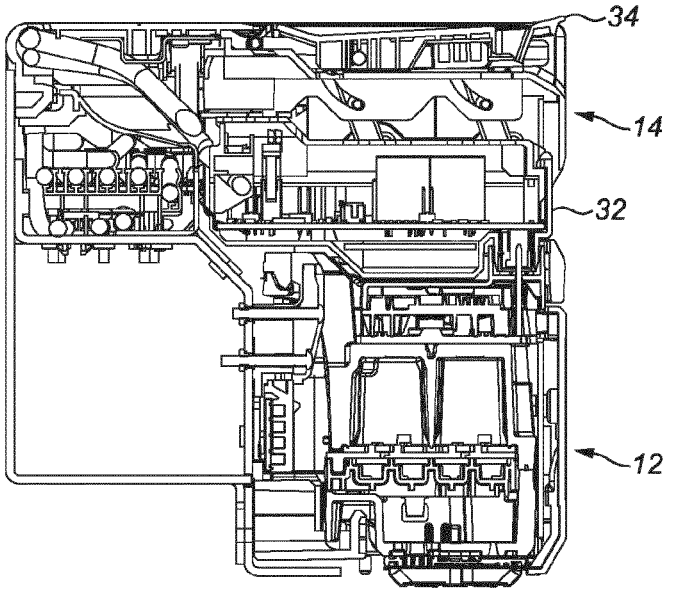

Referring to FIGS. 3*a* and *b*, the arrangement is shown with the latch 14 in its lockable position, with the handle 34 open in FIG. 3*a* and closed in FIG. 3*b*, and in which the platform 32 can be seen separated from the print head 12 in FIG. 3*a*, but in contact therewith in FIG. 3*b*.

Figure 5A:
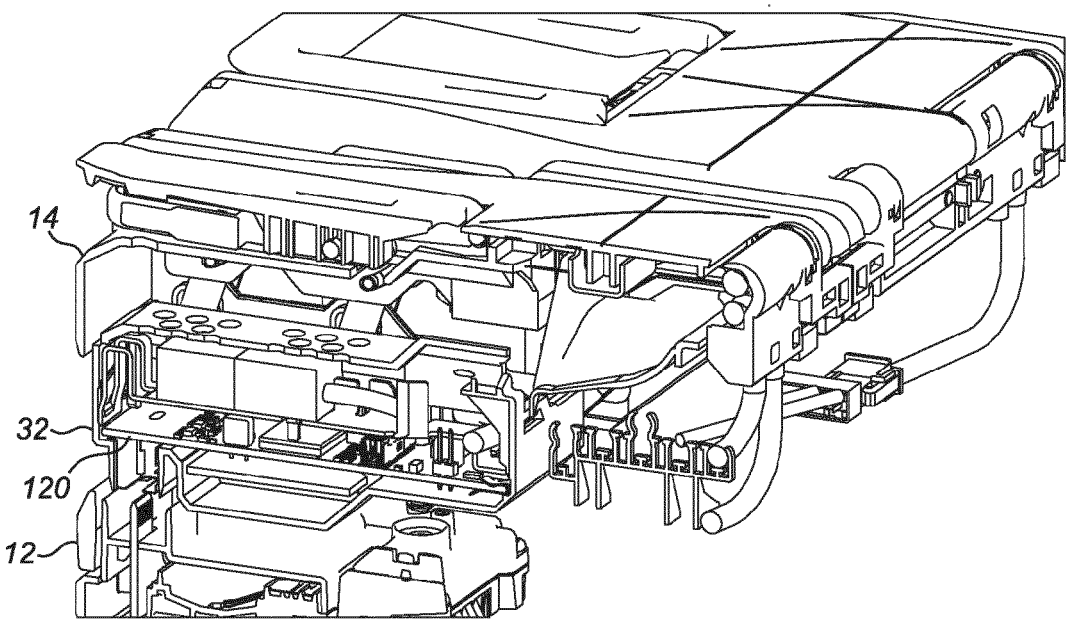
FIGS. 5*a* and *b* are cut perspective sections, just prior to final connection and in detail after final connection of the latch on the print head, according to an example.
Figure 5B:
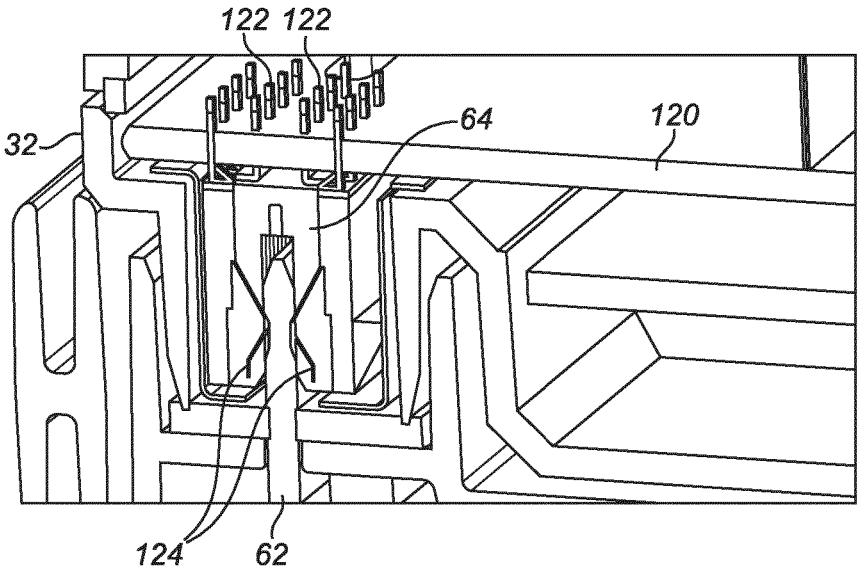

FIGS. 5*a* and 5*b* show the electrical connection 60 in more detail. Platform 32 includes a circuit board 120 to which a female connector 64 is attached through its connection pins 122. The connector 64 has wire contacts 124. Print head 12 also has a printed circuit board, carrying the components and circuits it needs, with an edge connector 62. From this it can be seen that the edge 62 needs to be aligned with the socket 64, otherwise damage may result to the connector 60, either the edge 62 or the contacts 124 in the socket 64. Indeed, a controlled entry with pure vertical (linear) movement is preferred. Consequently, it desirable that any pivoting movement of the latch 14 (about its hinge 16 to the print bar 10) is completed before the vertical movement of the connector 60 is effected. The same applies to the fluid connections 70, although they are potentially less susceptible to damage.

It is for this reason that the block 46 (described above) is provided. It prevents the handle 34 from being closed unless the latch is in its lockable position. It might be noted that, in the absence of the block 46, the latch could not necessarily pivot to its lockable position with the handle 34 being in its closed position. This would likely be prevented by the latch member 38 colliding with the element 44 forming the eye 42. Nevertheless, this would potentially damage the eye 42, or rather the component in which it was formed, and/or the latch member 38, bearing in mind the mass of the latch 14 and the leverage that mass has at the lock area (38/44), for example if the latch was dropped when at a 45 degree angle to the horizontal, the forces generated on the latch member and eye component could be substantial and damaging. This could be circumvented by, for example, providing the latch member with a ramp so that the latch member was displaced on closing of the latch, but the present arrangement is preferred because, even if the latch member did not prevent the latch from closing to its lockable position at some speed, the latch, or its connections 60,80 could potentially be damaged if the print head was not properly positioned in the receptor 20.

Consequently, the arrangement is such that the latch 14, from being locked closed in the lockable position shown in FIG. 3*b*, for example, cannot be raised without first opening the handle 34 by rotation thereof about its pivot 36 in a clockwise direction (in FIG. 9—anti-clockwise in FIG. 3*b*), whereby the platform 32 is first raised and separated from the print head 12, disconnecting the connections 60,80. Subsequently, the latch member 38 is withdrawn from the eye 42 as the handle 34 is rotated to its fully open position (shown in FIG. 3*a*), whereupon the latch can be pivoted open. As the latch opens, block 46 is allowed to enter the gap between latch member 38 (or a shoulder of it) and stop 52, whereupon the latch member is then unable to move rightwardly (in FIG. 9) and nor can the handle 34 close. This ensures that the platform 32 remains elevated (in the position shown in FIG. 3*a*).

Figure 6:
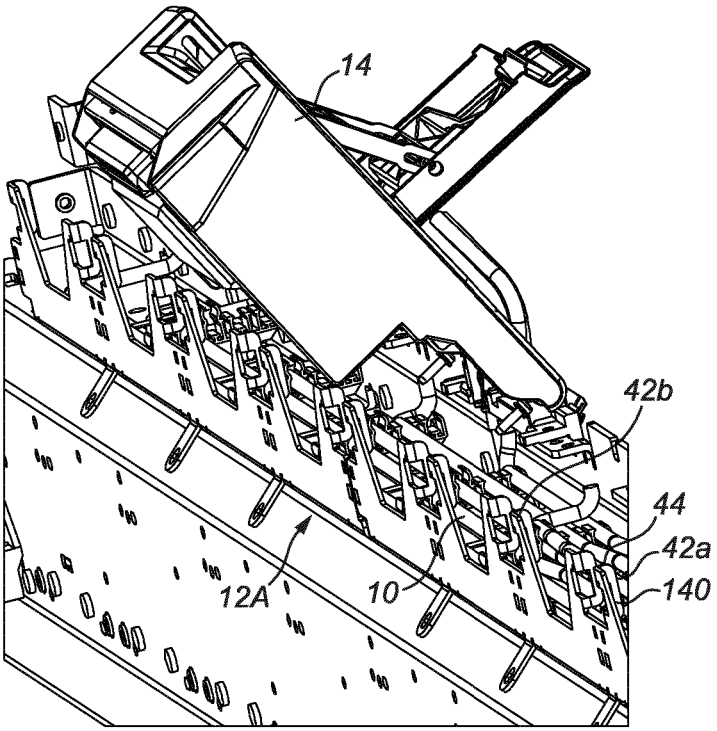
FIG. 6 is a perspective view of part of a bar and latch in an open position thereof, according to an example.

Now, should the latch be dropped from the position shown, for example, in FIG. 6, the latch can fall to its lockable position. No damage will be caused to the latch member or eye because the latch member is open. All that will happen is that the block 46 will be displaced, permitting the latch to be locked. Perhaps more importantly, however, with the platform 32 in its withdrawn position, any misalignment of the print head cannot cause damage to the connections 60,70.

Figure 7:
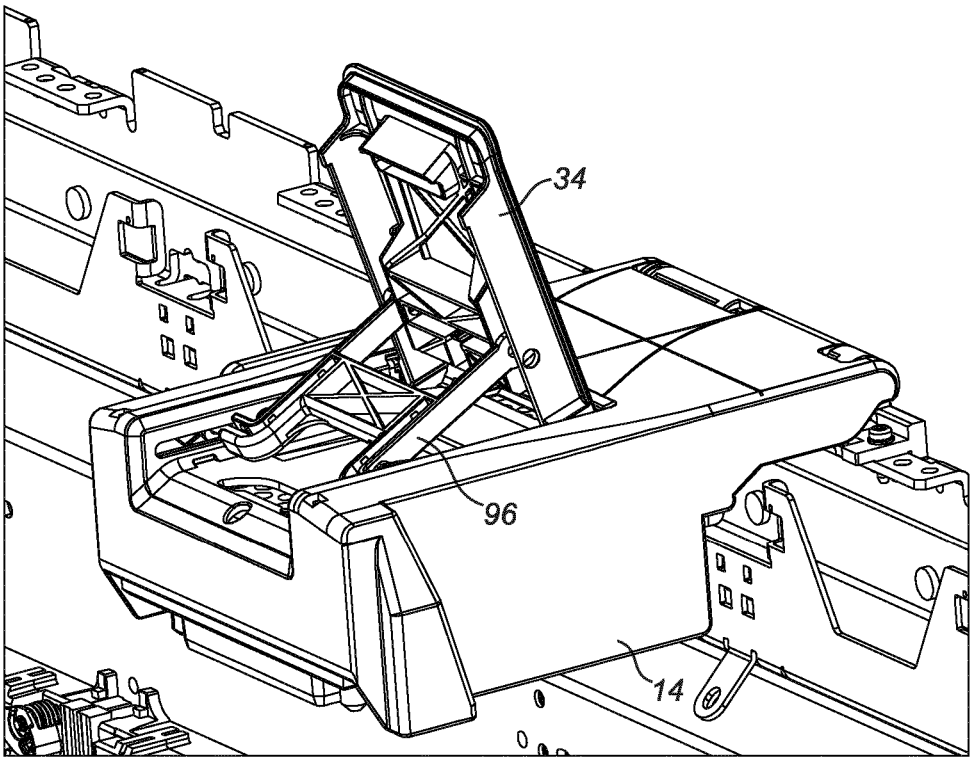
FIG. 7 is the same perspective view as FIG. 6, but with the latch in its lockable position, according to an example.

Turning to FIG. 6, the structure of the print bar 10 can be seen where upstanding flange 140 is provided with two eyes 42*a,b*, one on either side of a print head location 12A (the print bar is not shown with all its components). FIG. 7 shows the latch 14 in its lockable position, although it is not locked because the handle 34 is in its open position.

Figure 8A:
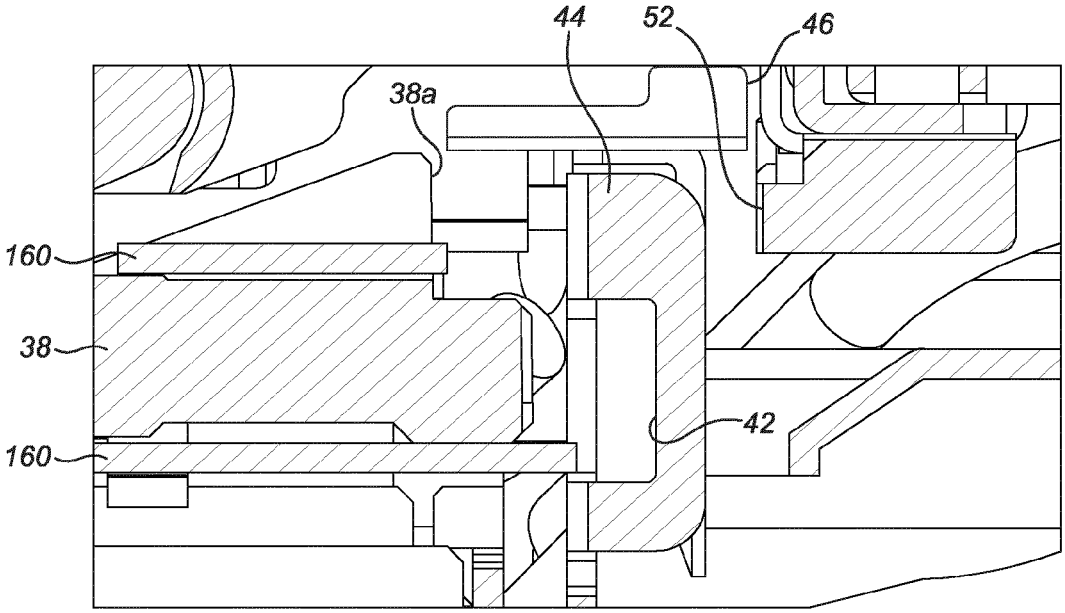
FIGS. 8*a* to *c* are detail views of a blocking mechanism to prevent actuation of a handle of the latch in the previous drawings, in an unlocked (ready to lock), locked, and unlocked (open) positions of the latch, according to an example.
Figure 8B:
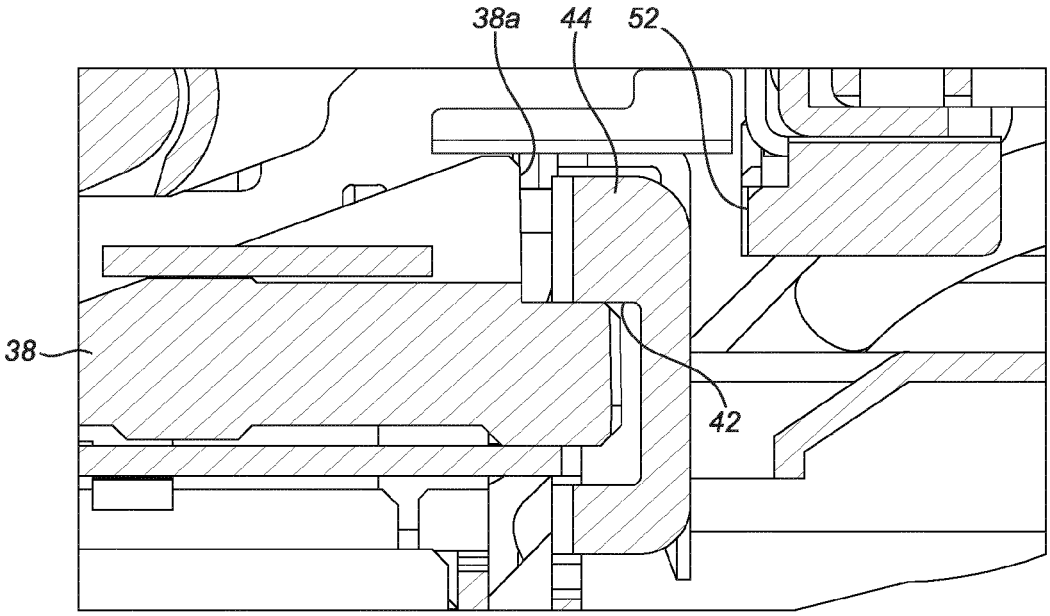

FIGS. 8*a, b* and *c* are detailed views of latch member 38 and eye 42. The catch member slides between guides 160 and is shown in the unlocked position in FIG. 8*a*, and in the locked position where it engages eye 42 in FIG. 8*b*. In both cases, the latch is in the lockable position where the eye 42, or rather its unlock-block element 44 has displaced spring block 46. Here, block 46 is a spring and so a separate spring 48 (as shown in FIG. 9 is not required.

Figure 8C:
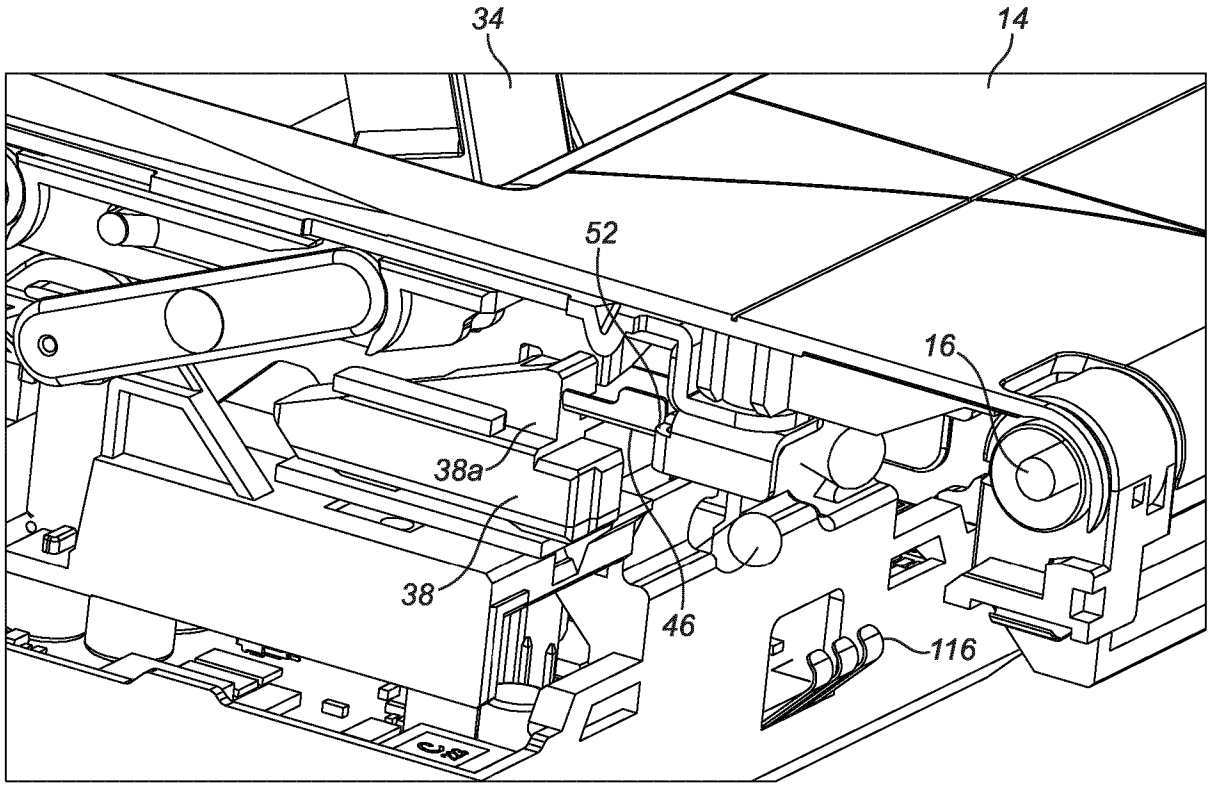

In FIG. 8*c*, the latch is open and so the spring block 46 has dropped between shoulder 38*a* of the latch member 38 and stop 52, preventing the latch member from moving to its locked position.

Electrical connections from the main body of the printer, carried in the printer bar 10, to the latch 14, may comprise wires that are flexed when the latch pivots about its hinge 16. However, a possible alternative arrangement comprises contacts 116 (see FIG. 8*c*) extending from the board 120 within the latch 14 to contact with terminal pads (not shown) on the printer bar 10. However, in the present arrangement, wires are used, the contacts 116 merely providing for grounding of the board 120.

An alternative arrangement is illustrated in more detail in FIGS. 10 to 13. Like numerals refer to the corresponding elements referred to with reference to FIGS. 4 and 9 above. In FIGS. 10A, B and C, handle 34 is pivoted about axis 36 from its closed position (FIG. 10A) through its second movement to an intermediate position (FIG. 10B) to its fully open position (FIG. 10C) after proceeding through its first movement. Thus, starting at its closed position, as handle 34 rotates clockwise, lever 96 is permitted to move from its closed position to a fully open position at the intermediate position. However, extension 34*c* as merely slid along circular abutment 37 of latch member 38 without effecting any movement thereof. It is retained in engagement with eye 42. However, there is a change at the intermediate position. First, the lever 96 is fully open, and further movement of the handle merely allows pivot link 196 between the handle 34 and lever 96 to slide in a slot 96*a* in the lever 96, without any further movement of the lever. Second, the extension 34*c* enters a detent 38*a* and moves the latch member 38 (leftwardly in FIG. 10) to disengage it from eye 42 and unlock the latch from the print bar. Thus, in reverse, starting from the open position of the handle 34 in FIG. 10C, its first movement closes the latch member 38 without affecting the lever 96, and its second movement (from the intermediate position of FIG. 10B) actuates the lever 96 without affecting the latch member 38. The first and second movements of the handle 34 are thus sequential in this arrangement.

Figure 11A:
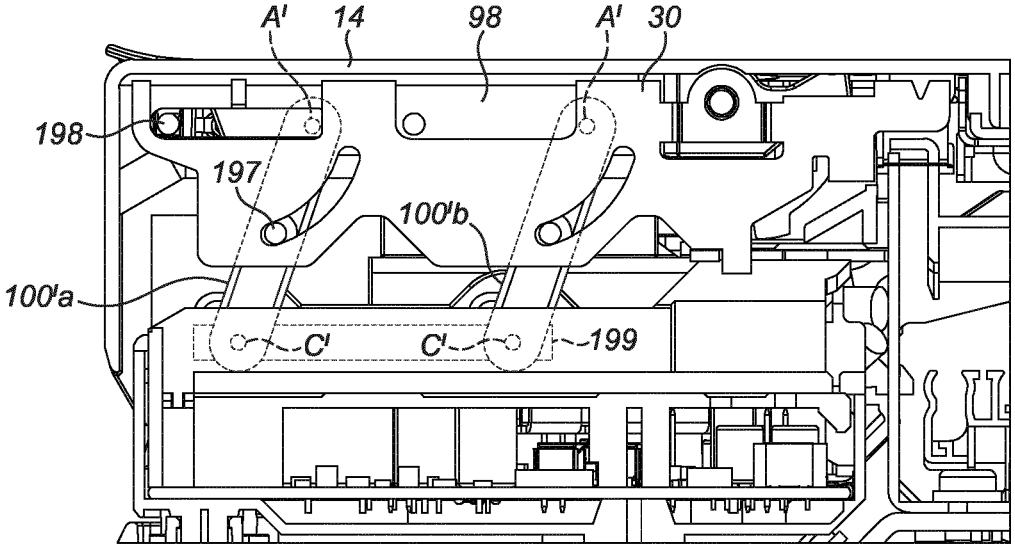
FIGS. 11*a* and *b* are side sections of details of the latch in FIG. 10 in closed and open positions of the handle.
Figure 11B:
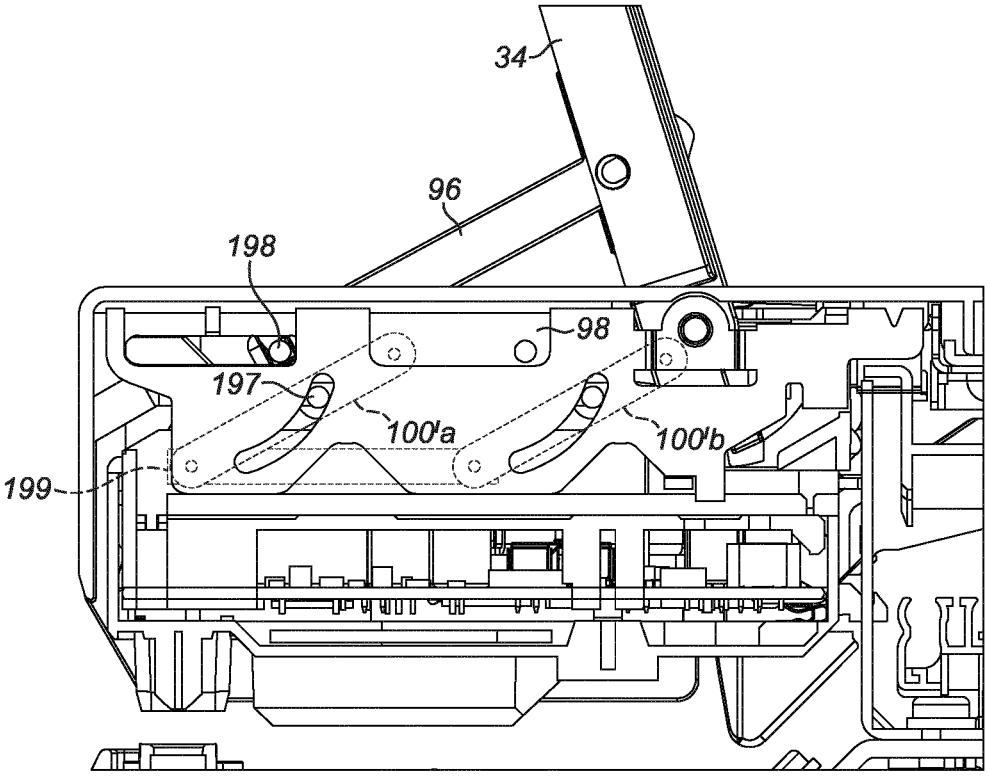

Turning to FIGS. 11*a,b*, the lever 96 is pivoted in the push bar 98 about pivot 198, and the handle 34 is shown closed in FIG. 11*a* and in the intermediate position in FIG. 11*b*. Push bar 98 is pivoted to modified Scott-Russel links 100'*a,b* about pins A'. Latch 14 has circular slots formed in its body 30 in which slide pivot pins 197 of the links 100'*a,b*. The other ends of the links 100'*a,b* are pivoted about pins C' in a dish plate 199. Thus, horizontal movement of the push bar is translated into vertical movement of the dish plate 199.

Figure 12:
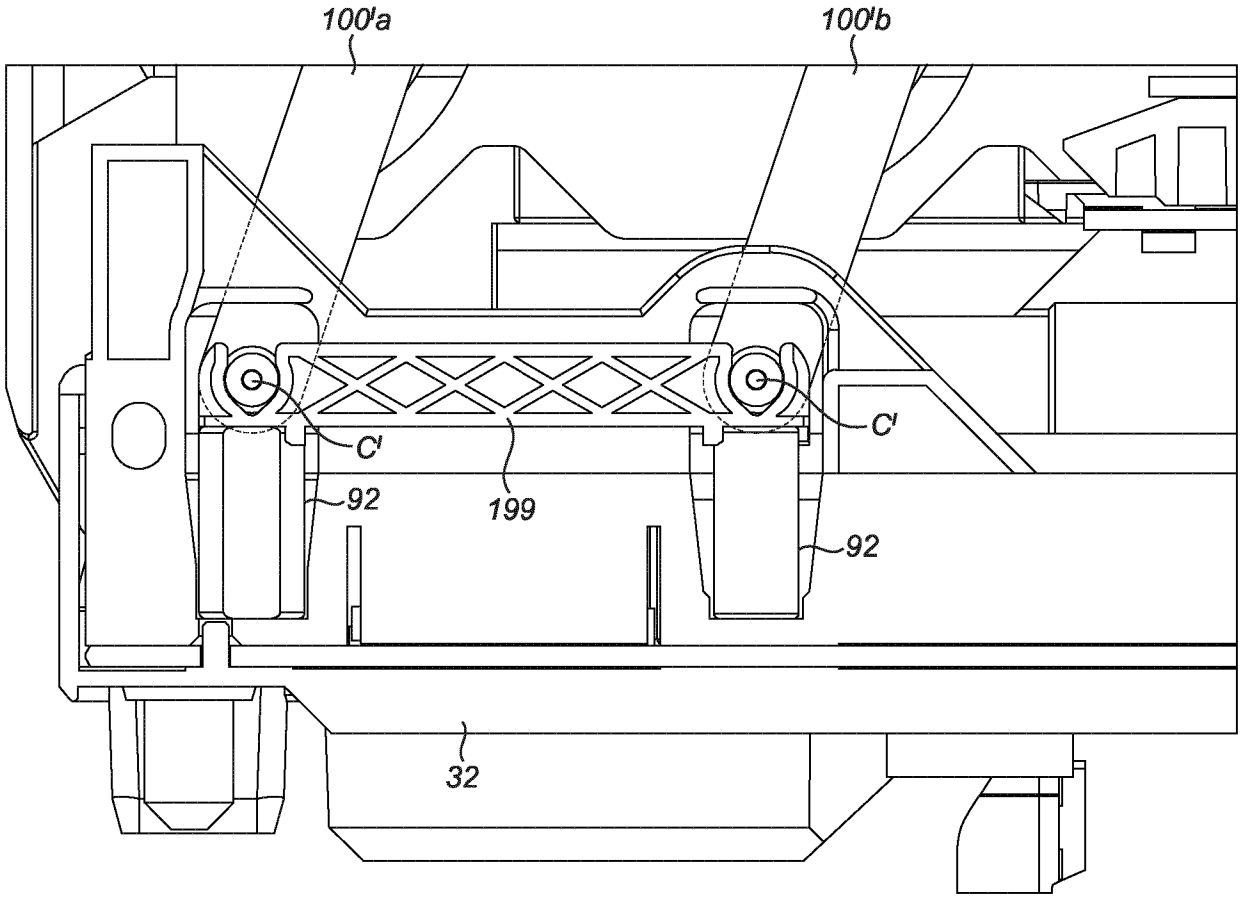
FIG. 12 is a further detail side section of a dish plate and springs used in the latch of FIG. 10.
Figure 13A:
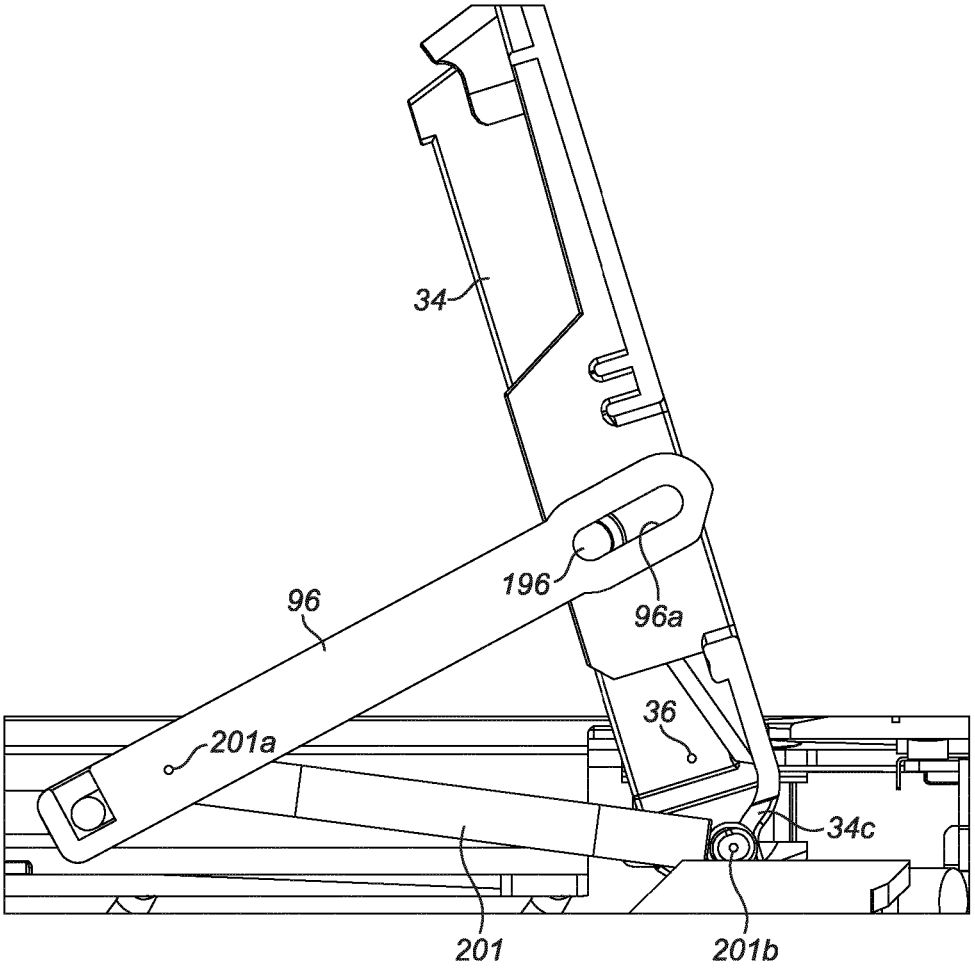
FIGS. 13*a* and *b* show a bistable return spring for the handle of the latch of FIG. 10.
Figure 13B:
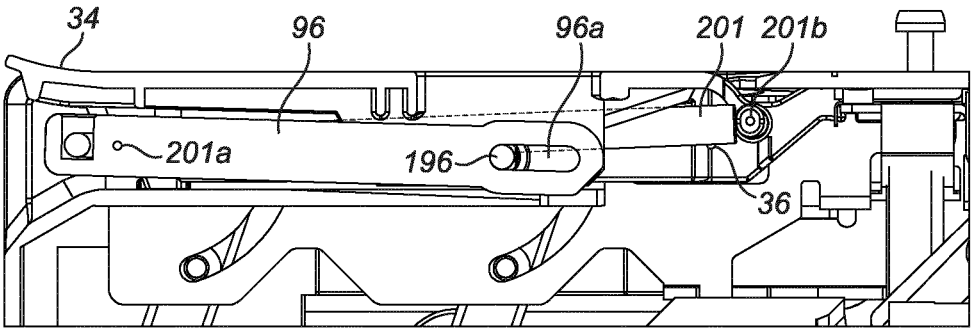

FIG. 12 illustrates the dish plate 199 in more detail, which can be seen to mount springs 92 that abut the platform 32. In this arrangement, when the handle 34 is open, the springs 92 are uncompressed. When the handle is closed and the platform lowered, the springs are only compressed when further lowering of the platform 32 is prevented by contact between the stud faces 110A,B. However, with this arrangement a detent or other lock arrangement is needed to retain the handle in its closed position on the latch and maximise the bias applied to the platform 32. For this purpose a tension spring 201 may be provided between lug 201*a* on the lever 96 and lug 201*b* on the extension 34*c* of the handle 34, whereby a bistable arrangement as shown in FIGS. 13*a* and *b* is provided. In the intermediate position of the handle 34, as shown in FIG. 13*a*, the spring 201 urges the lever 96 to its fully open position and continues to urge the handle to its fully open position (FIG. 10C) with the pin 196 sliding in slot 96*a*. On closing the handle 34, not only is spring 201 extended, but also springs 92 are compressed. However, on passing a cusp position when axis 36 of rotation of the handle 34 is aligned with lugs 201*a,b*, tension spring 201 works against springs 92. Because of the gearing/leverage provided by the arrangement of the links 100*a,b*, push bar 98 and lever 96, the tension spring 201 can be arranged to overcome the springs 92 and retain the handle 34 in the closed position shown in FIG. 13*b*.

Throughout the description and claims of this specification, the words "comprise" and "contain" and variations of them mean "including but not limited to", and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds, chemical moieties or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed.

The reader's attention is directed to all papers and documents which are filed concurrently with or previous to this specification in connection with this application and which are open to public inspection with this specification, and the contents of all such papers and documents are incorporated herein by reference.

Within the scope of this application it is expressly intended that the various aspects, embodiments, examples and alternatives set out in the preceding paragraphs, in the claims and/or in the following description and drawings, and in particular the individual features thereof, may be taken independently or in any combination. That is, all embodiments and/or features of any embodiment can be combined in any way and/or combination, unless such features are incompatible. The applicant reserves the right to change any originally filed claim or file any new claim accordingly, including the right to amend any originally filed claim to depend from and/or incorporate any feature of any other claim although not originally claimed in that manner.

The invention claimed is:

1. A print bar system for an inkjet printer comprising a print bar and a selectively replaceable print head attached to the print bar, the system comprising:

a receptor on the bar, for installation of a print head, each print head having a locator for engagement with said receptor by relative movement of the print head and print bar in a first direction;

a latch, movable to lockable position on the bar, the latch having a user-actuatable handle adapted, during a first movement thereof, to engage a latch member of the latch with a catch on the bar to lock the latch on the bar when the latch is in said lockable position;

a platform, mounted on the latch with freedom to move with respect to the latch in said first direction when the latch is in said lockable position;

a latch electrical connector on said platform, adapted to engage a head electrical connector on the print head by mutual movement of the connectors in said first direction when the latch is in said lockable position and the print head is installed in said receptor;

a bias, to urge said platform in said first direction when the latch is in said lockable position; wherein a second movement of the handle moves said platform relative to the latch; whereby, when the print head is installed in the receptor and the latch is in said lockable position, said first movement of the handle locks the latch in said lockable position and the second movement of the handle moves the platform in said first direction to engage said electrical connectors and urge the print head into secure engagement with the receptor.

2. The print bar system of claim 1, further comprising datum faces on said print head and print bar which meet when said locator is installed in said receptor and the print head is urged in said first direction, whereby the disposition of the print head with respect to the bar is ensured.

3. The print bar system of claim 1, wherein said first and second movements of the handle are sequential.

4. The print bar system of claim 1, wherein stud faces are provided on the print head and platform for mutual engagement once connection between said electrical connectors is complete, and whereby pressure of the bias is communicated from the latch to the print head without further pressure on said electrical connections.

5. The print bar system of claim 1, wherein the handle is pivoted at one end in the latch and at its other end is user actuatable.

6. The print bar system of claim 1, wherein said latch is pivoted to said print bar.

7. The print bar system of claim 1, wherein the platform further comprises a latch fluid connector and the print head further comprises a head fluid connector for engagement with said latch fluid connector by mutual movement of the connectors in said first direction when the latch is in said lockable position and the print head is installed in said receptor.

8. The print bar system of claim 5, wherein a lever is pivoted to the handle intermediate its ends and drives a push bar slidable in said latch in a direction transverse said first direction when the latch is in said lockable position, said push bar being linked to said platform by a link system.

9. The print bar system of claim 8, wherein said link system comprises parallel links connecting said push bar to a dish plate connected to said platform, wherein an intermediate point of said parallel links is restrained to move in an arc centred on an axis in the latch, whereby the movement directions of the push bar and dish plate are perpendicular.

10. The print bar system of claim 9, wherein each link has a pin at said intermediate point that slides in an arcuate slot in the latch.

11. The print bar system of claim 9, wherein each link is pivoted to an arm pivoted in the latch.

12. The print bar system of claim 8, wherein the dish plate is connected to the platform through said bias, whereby, when said stud faces have been mutually engaged, further movement of the handle biases the bias to press the stud faces together.

13. The print bar system of claim 12, wherein the handle has a detent to lock the handle in a closed position on the latch, to maximise the force of said bias.

14. The print bar system of claim 12, wherein the handle has a bistable spring element which urges the handle in a closing direction when the handle is between a cusp position of the handle and said closed position and in an opening direction when the handle is between said cusp position of the handle and said open position.

15. The print bar system of claim 8, wherein said bias is disposed between the platform and the latch and said dish plate is integral with said platform.

16. The print bar system of claim 15, wherein an element of lost motion is provided in the connection between the handle and the platform to accommodate tolerance in the engagement between the platform and print head.

17. The print bar system of claim 7, wherein the latch fluid connector incorporates a valve to seal the latch fluid connector when not connected, engagement of the fluid connectors opening said primer valve, which opening occurs in parallel with said electrical connection and before said stud faces engage.

18. The print bar system of claim 7, wherein the platform includes an electrically driven pump to drive air through said fluid connection to clean inkjets of the print head when the pump is energised.

19. The print bar system of claim 7, wherein engagement of said fluid connectors effects a seal between them comprising an O-ring around one connector squeezed by a seat of the other connector, the degree of bias applied against said O-ring by said bias when said stud faces engage being sufficient to ensure a satisfactory seal.

20. A pagewide array inkjet printer comprising a print bar and a selectively replaceable print head attached to the print bar, the printer further comprising:

a receptor on the bar, for installation of a print head, each print head having a locator for engagement with said receptor by relative movement of the print head and print bar in a first direction;

a latch, movable to lockable position on the bar, the latch having a user-actuatable handle adapted, during a first movement thereof, to engage a latch member of the latch with a catch on the bar to lock the latch on the bar when the latch is in said lockable position;

a platform, mounted on the latch with freedom to move with respect to the latch in said first direction when the latch is in said lockable position;

a latch electrical connector on said platform, adapted to engage a head electrical connector on the print head by mutual movement of the connectors in said first direction when the latch is in said lockable position and the print head is installed in said receptor;

a bias, to urge said platform in said first direction when the latch is in said lockable position; wherein a second movement of the handle moves said platform relative to the latch; whereby, when the print head is installed in the receptor and the latch is in said lockable position, said first movement of the handle locks the latch in said lockable position and the second movement of the handle moves the platform in said first direction to engage said electrical connectors and urge the print head into secure engagement with the receptor.

* * * * *